United States Patent [19]

Porter

[11] Patent Number: 4,653,558

[45] Date of Patent: Mar. 31, 1987

[54] LOG SPLITTER

[76] Inventor: George M. Porter, 3333 Hopkins Ave., Steger, Ill. 60475

[21] Appl. No.: 839,377

[22] Filed: Mar. 14, 1986

[51] Int. Cl.[4] ..... B27L 7/00

[52] U.S. Cl. ..... 144/193 A; 144/366

[58] Field of Search ..... 144/3 K, 193 R, 193 A, 144/366

[56] References Cited

U.S. PATENT DOCUMENTS

| | | | |
|---|---|---|---|
| 85,009 | 12/1868 | Jackson . | |
| 1,020,072 | 3/1912 | Barnhart | 144/193 A |
| 3,319,675 | 5/1967 | Bles, Jr. | 144/193 A |
| 4,239,070 | 12/1980 | Burns | 144/193 A |
| 4,366,848 | 1/1983 | Gavinski | 144/193 A |
| 4,411,298 | 10/1983 | Ellingsen et al. | 144/193 A |
| 4,453,580 | 6/1984 | Patten | 144/193 A |
| 4,454,899 | 6/1984 | Myers, Jr. | 144/193 A |
| 4,458,737 | 7/1984 | Klug | 144/193 A |
| 4,461,331 | 7/1984 | Mertz | 144/193 A |
| 4,470,441 | 9/1984 | Wirsbinski et al. | 144/193 A |
| 4,481,988 | 11/1984 | Watson et al. | 144/193 A |
| 4,506,712 | 3/1985 | Johnson | 144/193 A |

*Primary Examiner*—W. D. Bray

*Attorney, Agent, or Firm*—Allegretti, Newitt, Witcoff & McAndrews, Ltd.

[57] ABSTRACT

A log splitter trailer formed from an I-beam having a pair of opposing blades mounted on the top surface of the I-beam. An hydraulic cylinder is disposed between the blades for conjoint movement of a pair of rams toward respective blades. The rams slide along the top surface of the I-beam and are formed with depending portions which hook beneath the top surface for securement of the rams. The trailer axle is hollow, serving as an hydraulic reservoir.

10 Claims, 4 Drawing Figures

LOG SPLITTER

BACKGROUND OF THE INVENTION

The invention relates to an hydraulic log splitter having a pair of driving rams for splitting logs in either a forward or a return stroke.

Two-way hydraulic log splitters form part of the prior art. One such design is illustrated in U.S. Pat. No. 4,239,070 to Burns which discloses a log splitter having its driving force supplied beneath the logs by means of a pair of hydraulic cylinders and a slidably mounted ram. In the Burns device, the force supplied by the hydraulic cylinders is along a different line of force than the axis of the log. Thus, the Burns device exerts a force on the log in a direction that is not coincident with the axis of the log.

Another device shown by the prior art is U.S. Pat. No. 4,470,441 to Wirsbinski. The Wirsbinski device shows a single hydraulic cylinder that moves a double edged wedge back and forth to effect log splitting in either directions. Like Burns, Wirsbinski locates the hydraulic cylinder beneath the axis of the supplied log.

One problem associated with such log splitters which supply a direct splitting force along a different axis than that of the log, is that apparatus for redirecting that force is necessary. The apparatus used to redirect the force may be complex and susceptible to fatigue and failure due to the stresses exerted through them.

Another problem associated with such log splitters is that the log is more likely to move out of position as the splitting force is applied along a line different than the axis of the log. Because the force is applied from beneath the log, the log will tend to slide or pivot upwardly. In order to compensate for this tendency of the log to slip, the Burns apparatus must utilize a gripping design on the driving ram. Likewise, Wirsbinski utilizes a driving ram having a retaining lip to ameliorate the slipping problem.

The present invention constitutes an improved log splitter providing a double action splitting while at the same time providing a driving force coincident with the log axis, thereby providing a more simple, easily constructed design that is more durable.

SUMMARY OF THE INVENTION

Thus, it is an object of the present invention to provide a two way log splitter wherein the driving force is coincident with the axis of the log.

Yet another object of the present invention is to provide a log splitter wherein the log is less likely to slide or be forced out of position as the splitting force is applied to the log.

A further object of the invention is to provide a log splitter that is more durable and simpler to maintain.

A further object of the present invention is to provide a log splitter wherein energy used to force a log into a cutting edge is more efficiently transferred from an hydraulic cylinder to the log.

These and other objects of the invention are achieved in an improved log splitter employing an hydraulic cylinder for splitting logs by driving them against one of two cutting blades located at opposite ends of the log splitter. The hydraulic cylinder has a central axis that is coincident with the central axis of a log to be split. Two driving rams are driven by the hydraulic cylinder such that the hydraulic cylinder operates to split a log in either direction to which the cylinder is moved.

DETAILED DESCRIPTION OF A PREFERRED EMBODIMENT

Figure 1:
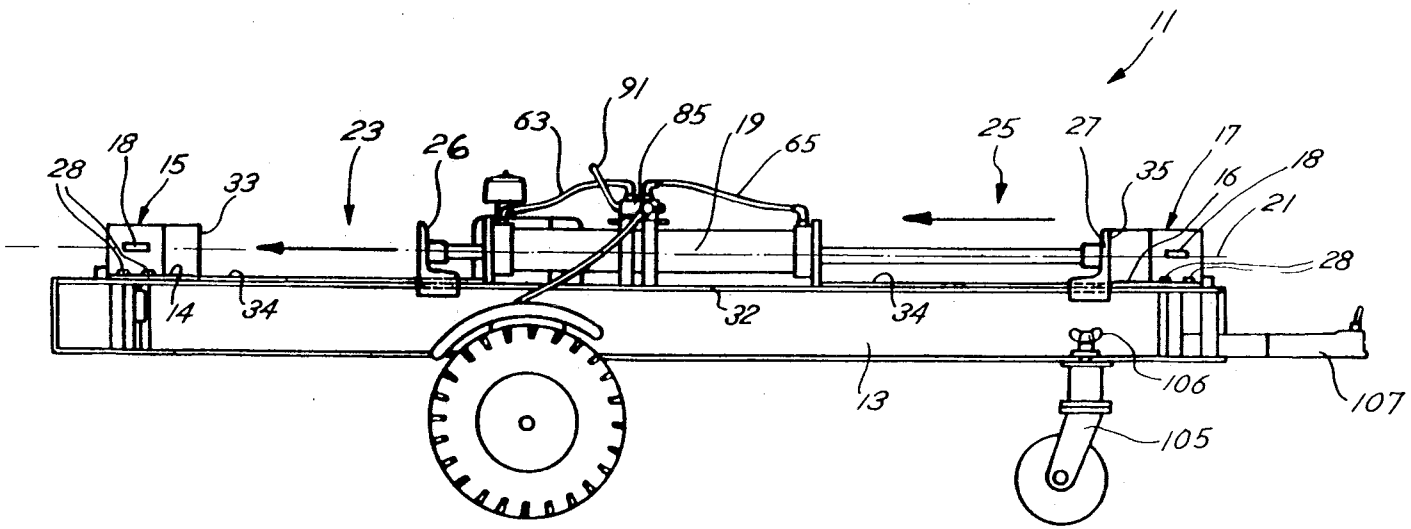
FIG. 1 is a side view of an embodiment of a log splitter.
Figure 2:
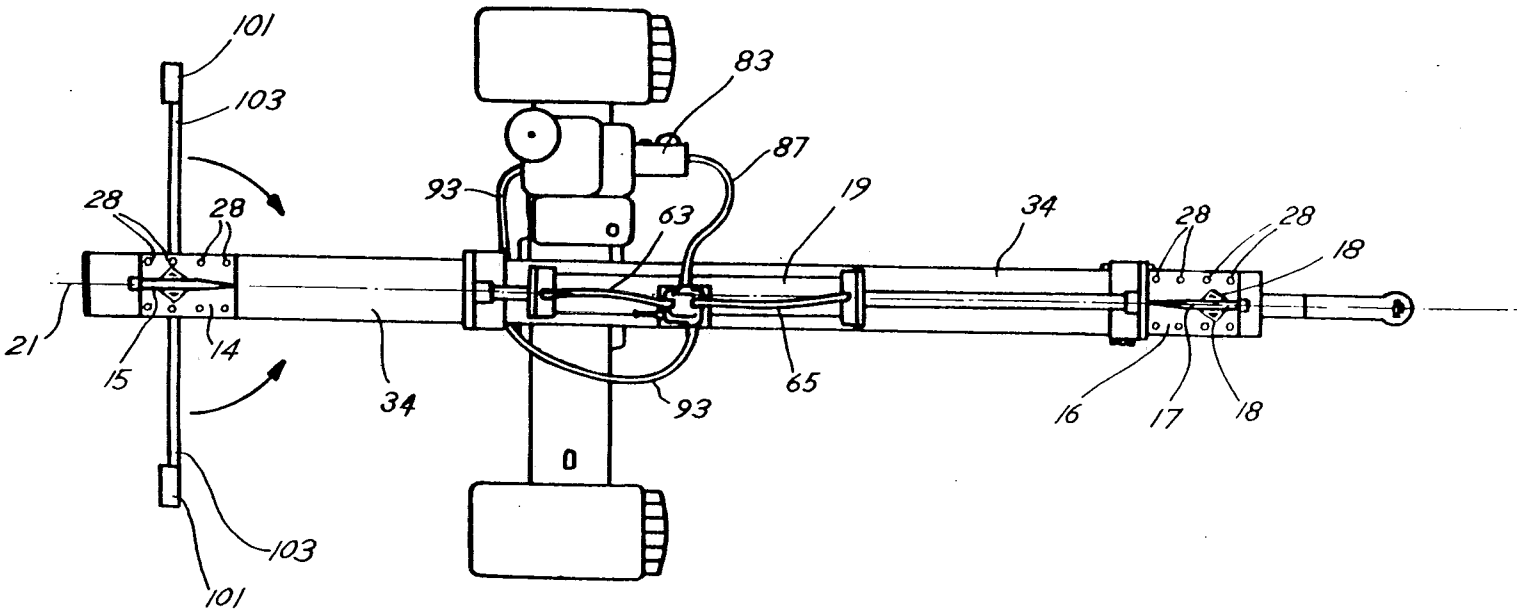
FIG. 2 is a top view of the log splitter of FIG. 1.

As shown in FIGS. 1 and 2, a log splitter 11 includes a frame 13, a pair of cutting blades 15, 17 and an hydraulic cylinder 19. Blades 15, 17 are positioned along a splitting axis 21 (FIG. 1) in facing opposition to one another. As seen in FIG. 2, the blades lie in a vertical plane that passes through axis 21. Hydraulic cylinder 19 is positioned between the confronting blades and along the splitting axis, providing work stations 23, 25 on either side of cylinder 19.

A log is placed in either work station 23, 25 for splitting. Hydraulic cylinder 19 drives a pair of rams 26, 27 in conjoint movement along the splitting axis within respective work stations 23, 25. Rams 26, 27 serve to force a log against cutting blades 15, 17 respectively for splitting the log.

Figure 3:
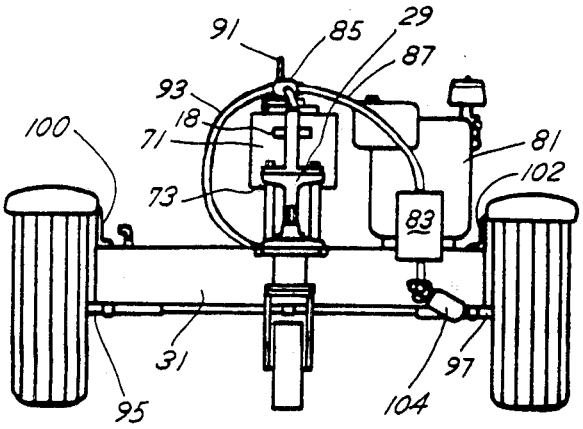
FIG. 3 is a front view of the log splitter of FIG. 1.

As shown in FIG. 3, frame 13 is preferably formed from an I-beam 29 secured atop an axle member 31. The top surface 32 (FIG. 1) of I-beam 29 provides a log support surface at each work station as well as a mounting area for securement of cylinder 19 and blades 15, 17 to the frame. As shown in FIG. 1, top surface 32 is covered by a pair of flat wear plates 34 positioned between cylinder 19 and each of blades 15, 17.

Cutting blades 15, 17 are secured to respective flat, rectangular base plates 14, 16, by welding or other conventional means. The base plates 14, 16 are attached at opposite ends of frame 11 by a plurality of machine bolts 28. As shown in FIG. 2, four (4) bolts 28 are placed on each side of each blade 15, 17. The two front bolts on each side of the blades are flathead bolts allowing the top of the bolt head to lie flush with the top surface of base plates 14, 16. This permits the logs to pass over the front bolt heads without interference. The back two bolts on each side of the blades have a conventional head as shown in FIG. 1.

Also, a pair of triangular deflectors 18 are formed from triangular shaped pieces of metal and are welded onto each side of blades 15, 17 as shown. Triangular deflectors 18 serve to deflect the split end of the log outwardly away from the blades during the splitting operation.

Each cutting blade 15, 17 has a respective cutting edge 33, 35 (FIG. 1) aligned along the splitting axis 21 as shown. In the preferred embodiment, hydraulic cylinder 19 is positioned approximately equidistant from cutting edges 33, 35 so that both stations of the log splitter accomodate logs of approximately equal size.

Figure 4:
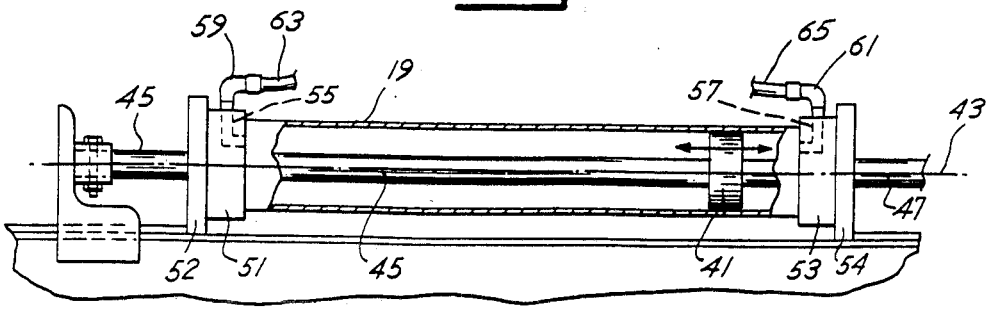
FIG. 4 is a side view of the hydraulic cylinder of the log splitter shown in FIG. 1.

Referring to FIG. 4, hydraulic cylinder 19 includes a piston 41 which is movable along the longitudinal axis 43 of cylinder 19. Longitudinal axis 43 defines the splitting axis 21 (FIG. 1) along which a direct splitting force is generated by cylinder 19. Piston 41 is driven from left to right or from right to left within hydraulic cylinder 19 by hydraulic fluid (not shown). The left side of piston 41 is attached to a piston rod 45 which extends along axis 43. The right side of piston 41 is attached to a piston rod 47 which also extends along axis 43. Piston rods 45, 47 are driven along the longitudinal axis 43 of hydraulic cylinder 19 in accordance with the movement of piston 41.

At each end of hydraulic cylinder 19 is an end member 51, 53 which includes a respective, hydraulic passage 55, 57 for passing hydraulic fluid into or out of hydraulic cylinder 19. End members 51, 53 are supported above and connected to I-beam 29 by supports 52, 54. At the top of each end member 51, 53 is a nozzle 59, 61 which communicates with passageways 55, 57. Hoses 63, 65 are connected to respective nozzles 59, 61 for conductance of hydraulic fluid into or out of the respective passageways 55, 57.

In order to move piston 41 toward the left (as viewed in FIG. 4), hydraulic fluid is passed through hose 65, nozzle 61, passageway 57 and against the right side of piston 41. As piston 41 is forced to the left by the hydraulic fluid, the hydraulic fluid disposed between the left side of piston 41 and end member 51 is forced out of hydraulic cylinder 19 via passageway 55, nozzle 59 and hose 63. Alternatively, to move piston 41 to the right (as viewed in FIG. 4), hydraulic fluid is transmitted through hose 63, nozzle 59, passageway 55 and against the left side of piston 41 within cylinder 19. As piston 41 moves toward the right, the hydraulic fluid between piston 41 and end member 53 is forced out of the hydraulic cylinder 19 via passageway 57, nozzle 61 and hose 65.

Referring again to FIG. 1, rams 26, 27 are secured to the outer ends of the respective piston rods. Each ram includes a flat face 71 (FIG. 3) for impacting one end of a log to drive the log against blades 15, 17. Each ram also includes a flat surface (not shown) for sliding atop wear plates 34 secured to surface 32 of I-beam 29.

As shown in FIG. 3, each ram is wider than the top surface of the I-beam. A depending portion 73 of the ram wraps around the top of the I-beam on each of its sides in order to hold the ram against the wear plates 34 during impact of the ram against a log. As will suggest itself, the depending portion 73 is a separate piece of metal, screw secured to the ram. This permits removal of the ram from the frame if necessary.

As shown in FIG. 3, an internal combustion engine 81 is connected to an hydraulic pump 83 which pumps hydraulic fluid into and out of cylinder 19 in order to perform the log splitting function. A control valve 85 (FIG. 1) permits manual control of the pathway of hydraulic fluid passing from pump 83 via a rubber hosing 87 (FIG. 2). Valve 85 will transmit the hydraulic fluid through either hose 63 or hose 65 depending upon the position of an operator handle 91.

Movement of handle 91 to the right (as viewed in FIG. 1) will cause piston 41 to be driven towards the right. Fluid will pass from rubber hosing 87 (FIG. 2) through hose 63 and into hydraulic cylinder 19. Fluid within the hydraulic cylinder 19 will correspondingly be expelled through hose 65 and then returned to a pump reservoir via a hose 93. The pump reservoir is formed from the hollow interior of axle member 31.

Referring to FIG. 3, axle member 31 is a hollow, rectangular box having axles 95, 97 welded to the underside of the member 31. Fenders 100, 102 are welded to the top side member 31. An hydraulic filter 104 is connected between the pump reservoir and pump 83.

Movement of control handle 91 toward the left (FIG. 1) will cause the hydraulic fluid from rubber hosing 87 to pass through hose 65 and into hydraulic cylinder 19. Fluid within the hydraulic cylinder 19 will be expelled through hose 63 and returned to the pump reservoir via hose 93.

As shown in FIG. 1, a conventional front wheel assembly 105 is secured to the underside of I-beam 29 for use in a conventional trailer fashion. A wing-nut 106, or the like, is used to release the assembly 105 which is hinged for swinging upwardly to be latched onto I-beam 29. This permits removal of the assembly during transport of the log splitter in a trailer fashion. A conventional trailer hitch 107 is attached to the front of the I-beam as shown.

As shown in FIG. 2, a pair of tail lights 101 are secured to light supports 103. Supports 103 are hingingly connected to the sides of I-beam 29 so that supports 103 may swing into and away from the sides of the I-beam. Latches are secured to the I-beam for holding the light supports against the beam.

It is to be understood, of course, that the foregoing describes a preferred embodiment of the present invention and that modifications may be made therein without departing from the spirit or scope of the present invention as set forth in the appended claims.

What is claimed is:

1. A log splitter trailer comprising:

a central frame having a cross-sectional I-shape and being disposed with a top surface substantially horizontal;

a first cutting blade and a second cutting blade, each said blade having a cutting edge, said cutting blades attached to said top surface of the frame and located at the opposite ends of said frame, said blades being positioned for having their cutting edges facing each other and lying in the vertical plane of the I-shaped frame;

an hydraulic cylinder attached to said top surface of said frame and disposed approximately equidistant from each said cutting blade, said hydraulic cylinder having a central axis lying in said vertical plane;

a piston moveably mounted within said cylinder for movement along said central axis, said piston having two opposite faces, a first piston rod having one end attached to one face of said piston and the other end extending through one end of said cylinder; a second piston rod having one end attached to the other face of said piston and the other end extending through the other end of said cylinder;

said piston rods being disposed substantially colinear with one another and with said central axis of the hydraulic cylinder;

a pair of driving rams, each said ram attached to a respective one of the other ends of said piston rod, said driving rams slidably mounted on said top surface of the frame, each said ram having an approximately flat driving face disposed perpendicular to said vertical plane of the frame, said driving faces oriented away from the hydraulic cylinder and toward their respective cutting blades for forcing a log against said blade with direct force from said cylinder; and hydraulic pumping means operatively connected to said hydraulic cylinder for pumping hydraulic fluid into and out of the hydraulic cylinder in order to drive the piston along the central axis of the cylinder.

2. A log splitter according to claim 1 wherein said rams include a portion which hooks beneath said top surface for retaining said rams to said top surface.

3. A log splitter according to claim 1 wherein each said blade includes a deflector means for guiding the split log outwardly from said blade.

4. A log splitter according to claim 3 wherein said deflector means includes a pair of triangular deflectors, each said deflector located on a respective side of a said blade.

5. A log splitter according to claim 1 and further including a wheel and axle assembly for transporting the trailer, said wheel and axle assembly including a hollow axle having an axis substantially orthogonal to said vertical plane, said hollow axle forming an hydraulic reservoir of said hydraulic pumping means.

6. A log splitter according to claim 5 wherein said hydraulic pumping means includes an hydraulic pump, said hydraulic pump supported by said hollow axle.

7. A log splitter according to claim 1 wherein said hydraulic cylinder includes a first end member and a second end member disposed at opposite ends of said cylinder, each of the end members having a hydraulic passage for passing hydraulic fluid into or out of the hydraulic cylinder; and each said end member having a nozzle in communication with the respective hydraulic passage, said nozzle attached to the top of the respective end member; and wherein said hydraulic pumping means includes hosing means for conducting hydraulic fluid into and out of each said nozzle; and control valve means connected to said hosing means for controlling the flow of hydraulic fluid to and from each hydraulic passage; and an hydraulic pump for pumping hydraulic fluid to said control valve means.

8. A log splitter according to claim 1 and further including a tail light assembly comprising a pair of arms, each said arm swingably mounted to a respective side of said frame for swinging into and away from said frame; and a pair of tail lights, each attached to the outer end of a respective arm.

9. A log splitter according to claim 1 wherein said blades are removably mounted to said frame.

10. A log splitter according to claim 1 wherein said top surface includes a wear surface.

* * * * *